US007028464B2

(12) United States Patent
Rösel et al.

(10) Patent No.: US 7,028,464 B2
(45) Date of Patent: Apr. 18, 2006

(54) METHOD FOR PURIFYING EXHAUST GAS OF AN INTERNAL COMBUSTION ENGINE

(75) Inventors: Gerd Rösel, Regensburg (DE); Hong Zhang, Tegernheim (DE)

(73) Assignee: Siemens Aktiengellschaft, Munich (DE)

( * ) Notice: Subject to any disclaimer, the term of this patent is extended or adjusted under 35 U.S.C. 154(b) by 136 days.

(21) Appl. No.: 10/473,970

(22) PCT Filed: Mar. 8, 2002

(86) PCT No.: PCT/DE02/00839

§ 371 (c)(1),
(2), (4) Date: Oct. 3, 2003

(87) PCT Pub. No.: WO02/081887

PCT Pub. Date: Oct. 17, 2002

(65) Prior Publication Data

US 2004/0103642 A1 Jun. 3, 2004

(30) Foreign Application Priority Data

Apr. 5, 2001 (DE) ..... 101 17 050

(51) Int. Cl.
*F01N 3/00* (2006.01)

(52) U.S. Cl. ..... 60/285; 60/274; 60/276; 60/297; 204/424; 204/427

(58) Field of Classification Search ..... 60/274, 60/276, 285, 297, 301; 204/408, 425, 424, 204/427, 426, 428, 429; 205/781
See application file for complete search history.

(56) References Cited

U.S. PATENT DOCUMENTS 5,452,576 A * 9/1995 Hamburg et al. ..... 60/274

(Continued)

FOREIGN PATENT DOCUMENTS

DE 19819461 A1 11/1999

(Continued)

*Primary Examiner*—Binh Q. Tran
(74) *Attorney, Agent, or Firm*—Morrison & Foerster LLP

(57) ABSTRACT

A method for purifying the exhaust gas from an internal combustion engine, which is operated under lambda-based closed loop control and which has an exhaust gas tract in which is located a catalytic converter, is provided. According to this method, a pre-converter lambda value for the exhaust gas is continuously sensed upstream of the catalytic converter, from which a pre-converter lambda signal is generated, and this pre-converter lambda signal is used as the reference variable for the lambda control loop. A post-converter lambda value for the exhaust gas is continuously sensed downstream from the converter, from which a post-converter lambda signal is generated, this being a monotonically decreasing function of the lambda value for the exhaust gas downstream from the catalytic converter. The post-converter lambda signal is used in a trimming control loop to apply a correction to the lambda control loop, whereby a measurement signal is generated which, at least below a certain value of lambda close to lambda=1, is a strictly monotonically increasing or monotonically decreasing function of the lambda value for the exhaust gas downstream from the catalytic converter. For levels of the post-converter lambda signal which are above a threshold value, this supplementary measurement signal is used for trimming control. For levels of the post-converter lambda signal which are below the threshold value, the post-converter lambda signal itself is used for trimming control.

9 Claims, 2 Drawing Sheets

U.S. PATENT DOCUMENTS

| | | | | |
|---|---|---|---|---|
| 5,842,340 | A * | 12/1998 | Bush et al. | 60/274 |
| 6,378,295 | B1 * | 4/2002 | Heinze | 60/274 |
| 6,427,437 | B1 * | 8/2002 | Bidner et al. | 60/274 |
| 6,490,856 | B1 * | 12/2002 | Bidner et al. | 60/274 |
| 6,546,720 | B1 * | 4/2003 | van Nieuwstadt | 60/286 |

FOREIGN PATENT DOCUMENTS

| | | | |
|---|---|---|---|
| DE | 19852244 | C1 | 12/1999 |
| EP | 11463132 | A2 | 10/2001 |
| WO | WO 94/19593 | | 9/1994 |

* cited by examiner

METHOD FOR PURIFYING EXHAUST GAS OF AN INTERNAL COMBUSTION ENGINE

This application claims priority to International Application No. PCT/DE02/00839 which was published in the German language on Oct. 17, 2002.

TECHNICAL FIELD OF THE INVENTION

The invention relates to a method for purifying the exhaust gas from an internal combustion engine which is operated under lambda-based closed loop control and which has an exhaust gas tract in which is located a catalytic converter.

BACKGROUND OF THE INVENTION

To purify the exhaust gas in the case of internal combustion engines which operate on the Otto principle, a three-way catalytic converter is usually located in the exhaust gas tract of the internal combustion engine. Upstream from this catalytic converter is a lambda probe, which delivers a signal that is a function of the proportion of residual oxygen contained in the exhaust gas. This residual oxygen content is in turn dependent on the mixture which is fed into the internal combustion engine. When there is an excess of fuel (rich mixture, or air volumes with lambda<1), the proportion of oxygen in the raw exhaust gas is lower, and when there is an excess of air during combustion (lean mixture or air volumes with lambda>1) the proportion is higher.

The lambda probes which are usually used upstream from the catalytic converter, which because of their position are also referred to as pre-converter lambda probes, are so-called binary or step probes. For these, when the mixture is lean (lambda>1), the output voltage usually lies below 100 mV. For stochiometric combustion with lambda=1, the output voltage increases in a step-like fashion. With a rich mixture (lambda<1), the output voltage reaches values over 0.6 V; this is described as two-point behavior. It is characteristic of this two-point behavior of binary lambda probes that, in the region where the characteristic curve exhibits a steep slope, the signal delivered by the lambda probe is therefore very strongly dependent on the value of lambda for the exhaust gas. As the mixture becomes richer from a point close to a lambda value of 1, the slope of the characteristic curve flattens off significantly. With currently-available binary lambda probes, the kink in the characteristic curve which this produces lies at around lambda=0.998.

There are also lambda probes which supply a unique, strictly monotonically increasing signal over a wide range of lambda values (between about 0.7 and 4). These lambda probes are referred to as linear lambda probes or broadband lambda probes.

An internal combustion engine running under closed loop lambda control operates in such a way that the output signal from the lambda probe, which reflects the lambda value for the raw exhaust gas, fluctuates about a predetermined mean value, which corresponds roughly to lambda=1. Because a three-way catalytic converter exhibits its optimal catalytic properties for a raw exhaust gas with a certain value $\lambda_0$ of lambda, the predetermined mean value should also actually correspond to $\lambda_0$. Depending on the catalytic converter, the value $\lambda_0$ of lambda for which the optimal catalytic effect is achieved, can lie at a value which differs slightly from lambda=1, for example at lambda=0.99, or in particular lambda=0.998.

The dynamic and static characteristics of each lambda probe change as a result of aging and contamination. This causes the position of the signal level which corresponds to $\lambda_0$ to be displaced. The familiar way of dealing with this problem is to locate a further lambda probe downstream from the three-way catalytic converter so that, because of its lower thermal loading and its position downstream from the catalytic converter, it is subject to less serious attacks from chemically aggressive substances. This lambda probe, which because of its position downstream from the catalytic converter is also referred to as a post-converter lambda probe, serves as a monitoring probe, for monitoring the catalytic conversion, and permits fine regulation of the fuel/air mixture, in that the signal level from the pre-converter lambda probe which is set to correspond to $\lambda_0$ is corrected so that the value $\lambda_0$ of lambda which is most the favorable for the catalytic conversion can always be adhered to on average. This method is described as closed loop guidance or trimming control.

DE 198 19 461 A1 describes a closed loop trimming method with which the signal from an $NO_x$-sensitive transducer, located downstream from a three-way catalytic converter, is used instead of the signal from a post-converter lambda probe. A similar closed loop trimming method which uses an $NO_x$-sensitive transducer is described in DE 198 52 244 C1.

As progress has been made in the reduction of the pollutants emitted by an internal combustion engine, three-way catalytic converters have become available which exhibit a significantly increased conversion rate for hydrocarbons, carbon monoxide and oxides of nitrogen. However, it has been found that such high-efficiency catalytic converters change the behavior of the post-converter lambda probes so that in effect the characteristic curve for the probe in the rich fuel/air mix region, i.e. for lambda values<1, has a significantly flatter slope than for factory-fresh probes or for aged probes which have been operated with conventional three-way catalytic converters. Furthermore, aging also generally leads to a displacement of the signal level, i.e. to a change in the offset, so that in the region of rich fuel/air mixtures the signal level decreases, which means that it is no longer possible to evaluate the signal reliably because it lies outside the manufacturer's specifications. This displacement by an offset also heightens the problem of the flattening of the curve. With probes which have aged in this way, it is no longer possible to exercise trimming control with the necessary accuracy, or the desired longevity of the post-converter lambda probe is not achieved.

SUMMARY OF THE INVENTION

According to an aspect of the invention, a method is provided for purifying the exhaust gas from an internal combustion engine operated under lambda-based closed loop control, which enables trimming control to be used with high-efficiency three-way catalytic converters combined with a longer service life for the post-converter lambda probe.

According to an aspect of the invention, a method for purifying the exhaust gas from an internal combustion engine which is operated under lambda-based closed loop control and which has an exhaust gas tract in which is located a catalytic converter is provided. According to this method, a lambda value for the exhaust gas is continuously sensed upstream of the catalytic converter (pre-converter value), from which a pre-converter lambda signal is generated, and this pre-converter lambda signal is used as the reference variable for the lambda control loop, and a lambda value for the exhaust gas is continuously sensed downstream from the converter (post-converter value), from which a post-converter lambda signal is generated, this being a monotonically decreasing function of the lambda value for the exhaust gas downstream from the catalytic converter, and where the post-converter lambda signal is used in a trimming control loop to apply a correction to the lambda control loop. A measurement signal is generated which, at least below a certain value of lambda close to lambda=1, is a strictly monotonically increasing or monotonically decreasing function of the lambda value for the exhaust gas downstream from the catalytic converter, and for levels of the post-converter lambda signal which are above a threshold value this supplementary measurement signal is used for trimming control, and for levels of the post-converter lambda signal which are below the threshold value the post-converter lambda signal itself is used for this purpose.

In accordance with this aspect of the invention, the signal from a post-converter lambda probe will continue to be used for trimming control. However, over the range of lambda values in which the signal from this probe is no longer suitable for trimming control, another measurement signal is generated for use in trimming control. The point at which this range is reached, in which the signal from the post-converter lambda probe is no longer sufficiently accurate, will be decided by reference to the level of the post-converter lambda signal. If the level of this signal is above a threshold value, the measurement signal will be used for trimming control. If the level of the post-converter lambda signal lies below the threshold value, the post-converter lambda signal will be used in the familiar way for trimming control.

This approach has the advantage that trimming control based on the conventional post-converter lambda signal remains unchanged in the ranges in which it continues to show what are known to be good results. Only in those ranges in which the post-converter lambda signal is, due to the characteristics of the high-conversion catalytic converters, no longer suitable throughout the entire service life, is that signal replaced by the measurement signal.

The requirements to be met by this measurement signal are relatively limited. It should permit a more precise statement of the lambda value than the post-converter lambda signal does, but only in the doubtful region, i.e. when the post-converter lambda signal lies above the threshold value. This implies that there is a unique correspondence between the measurement signal and the lambda value for the exhaust gas downstream from the catalytic converter, for which reason the measurement signal must be a strictly monotonic function, either increasing or decreasing, of the lambda value.

The threshold value should be in such a position that when the level of the post-converter lambda signal lies below this threshold the accuracy of the post-converter lambda signal is sufficient for trimming control. Above the threshold value for trimming control the post-converter lambda signal is no longer used for trimming control, but the measurement signal is used instead, so it is particularly appropriate to select the threshold value such that above this threshold value none of the signal levels allows adequate resolution of the lambda value for trimming control. The threshold value is therefore determined by the precision requirements, which the post-converter lambda signal must meet for trimming control, and by the measurement accuracy which the post-converter lambda signal can guarantee by its dependence on the lambda value for the exhaust gas.

Because of the two-point nature of its graph, the probe signal in the region of lambda=1 has a very steep slope. This makes it possible to define the threshold value exactly so that it corresponds to lambda=1. The steep slope also ensures that this correspondence can be made with high accuracy.

One signal which meets these requirements and could be used for the measurement signal in the invention is the output signal from a broadband lambda probe. Such a broadband lambda probe is advantageous because its characteristic curve has a relatively constant slope over a wide range of lambda values, in particular over the range which must be considered for the trimming control of an internal combustion engine with a stochiometric fuel/air mix operated under lambda-based closed loop control. This makes it particularly simple to change over to the measurement signal from the broadband lambda probe when the signal from the post-converter lambda probe lies above the threshold value.

However, broadband lambda probes have the disadvantage that sometimes as the probe ages a considerable displacement of the signal level occurs. Such behavior, which occurs particularly with lower cost broadband lambda probes, has until now excluded their use as the sole transducer downstream from a three-way catalytic converter in a trimming control loop. In accordance with a preferred aspect of the invention, the chosen threshold value for the post-converter lambda signal will correspond to a defined lambda value close to lambda=1; at the point in time at which the post-converter lambda signal is equal to the threshold value the difference between the lambda value indicated by the measurement signal and the defined lambda value will be determined, and this difference will be taken into account in exercising trimming control whenever the measurement signal is being used for this purpose.

This will allow any change in the signal level, in particular any change in the offset, due to ageing of the broadband lambda probe which is providing the measurement signal, to be compensated for.

If the post-converter lambda probe signal from the binary post-converter lambda probe reaches the threshold value, then at this point in time the composition of the exhaust gas which is present has a particular lambda value; that is to say, at this point in time the lambda value for the exhaust gas is known. Using this knowledge of the lambda value, the measurement signal from the broadband lambda probe can be corrected with respect to any additive errors which may be present. Hence, a compensation for errors in the measurement signal from the broadband lambda probe is determined at the threshold value.

The exhaust gas from an internal combustion engine which is operated with a rich mixture contains relatively little in the form of oxides of nitrogen, because of the surplus fuel during combustion, compared with lean combustion, in which there is surplus air. Hence, one would expect no noticeable relationship between the sensor signal and the lambda value for an $NO_x$ sensor in the lean region, i.e. for lambda values<1. However, the combustion of a rich fuel/air mixture produces NH3. It is therefore possible and advantageous to generate the measurement signal required for the invention by means of an $NO_x$ transducer which has a cross-sensitivity to NH3. This development is advantageous, in particular, with internal combustion engines which are equipped with an $NO_x$ transducer, for example to control an $NO_x$ catalytic converter. With this development, in which the post-converter lambda signal is obtained using a binary lambda probe signal and for which the measurement signal, obtained from an $NO_x$ probe which exhibits cross-sensitivity to $NH_3$, is a strictly monotonically decreasing function of the lambda value for the exhaust gas below lambda=1, it is possible to use the measurement transducers which are in any case already provided. No additional transducers are then required. By this method, it is possible to exploit positively a property of $NO_x$ transducers which until now has in and of itself been regarded rather as disruptive, and therefore has been reduced as far as possible.

If a binary lambda probe is used to provide the post-converter lambda signal, it is preferable that the threshold value is 0.45 V.

According to another aspect of the invention, a broadband lambda probe can be used to generate a linear post-converter lambda signal which is a strictly monotonic increasing function of the lambda value of the exhaust gas downstream from the catalytic converter, this linear post-converter lambda signal is used by the trimming control and if the binary post-converter lambda signal has a defined level the actual signal level for the linear post-converter lambda signal is simultaneously determined, the lambda value which has been assigned to the defined binary post-converter signal level is used to determine a corresponding set level for the linear post-converter signal and the trimming control takes into account any difference between the actual signal level and the set signal level as a correction factor, in particular as an additive factor for offset correction.

In this development, the signal from a broadband lambda probe is used continuously for trimming control. In order to compensate for displacements of the signal level due to ageing with such a post-converter lambda signal, the output signal from a binary post-converter lambda probe is evaluated in addition, to permit compensation in the manner described for the displacement of the post-converter lambda signal used for trimming control. This method permits a post-converter lambda signal to be used continuously for trimming control. It is not necessary to effect a switch-over.

Compensation for the offset can be effected intermittently at certain intervals of time. The latter should be chosen such that, between the times at which the compensation is effected, no change in the offset can occur which could lead to impermissible errors in the trimming control.

DETAILED DESCRIPTION OF THE PREFERRED EMBODIMENTS

Figure 1:
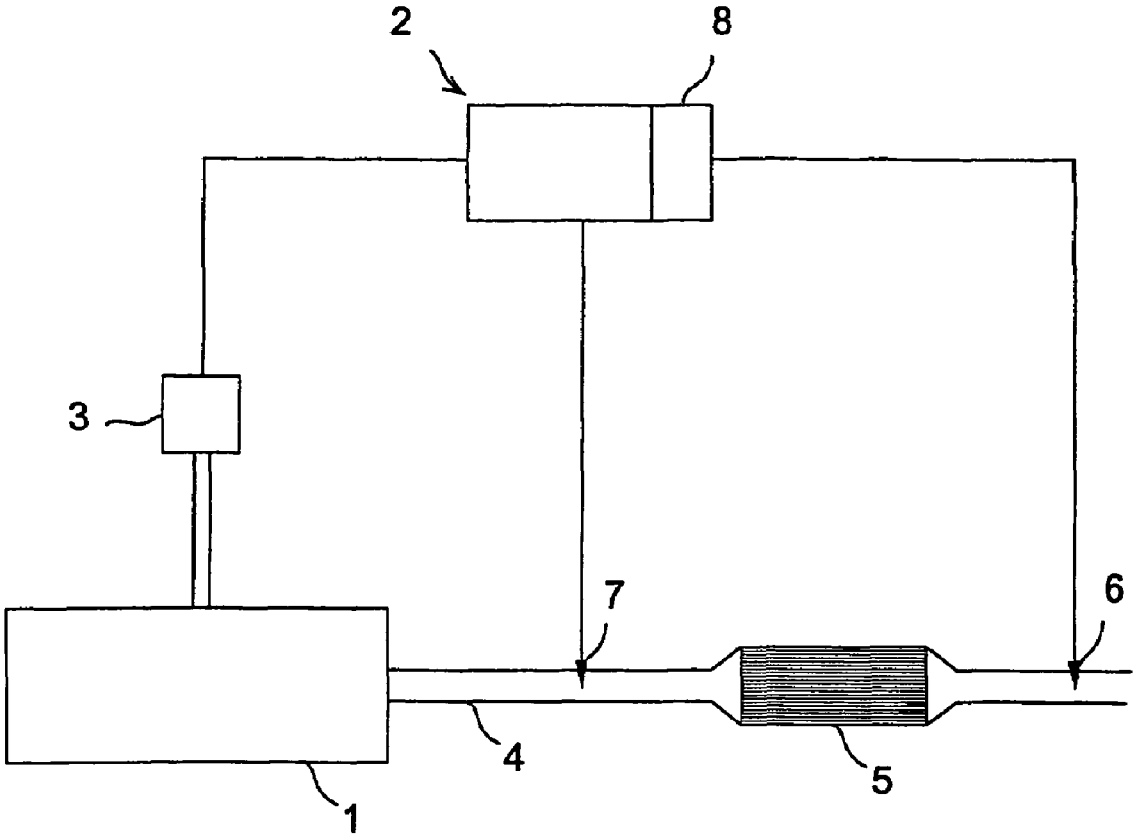
FIG. 1 is a schematic block diagram of an internal combustion engine with a gas purification system.

The invention concerns the purification of the exhaust gas from an internal combustion engine by an exhaust gas purification system, such as that shown schematically in FIG. 1. This can be an internal combustion engine working either by the induction of a fuel/air mixture or by direct fuel injection. The operation of the internal combustion engine 1 in FIG. 1 is controlled by an engine management unit 2. A fuel feed system 3, which could for example be constructed as an injection system, is controlled by wiring which is not shown in more detail from the engine management unit 2, and handles the fuel distribution for the internal combustion engine 1. In the latter's exhaust gas tract 4 there is a catalytic converter 5, which has three-way properties. In addition, it exhibits an $NO_x$-reducing function, to regulate which an $NO_x$ transducer 6 is provided downstream from the catalytic converter 5. However, what follows is not concerned with how the $NO_x$-reducing effect of the exhaust gas purification system works. Due to its three-way properties, the catalytic converter 5 has its optimal efficiency at a lambda value of $\lambda_0$. Depending on the catalytic converter, $\lambda_0$ can lie between 0.99 and 1.

For the purpose of operating the internal combustion engine 1 with lambda-based closed loop control, which is necessary for the optimal three-way effect of the catalytic converter 5, a pre-converter lambda probe 7 is provided upstream from the catalytic converter 5, and like the $NO_x$ transducer 6 this probe also transmits its measured values to the engine management unit 2 via wiring which is not shown in more detail. The measured values from further transducers, in particular for the engine speed, load, temperature of the catalytic converter etc., are also fed to the engine management unit 2. With the help of these measured values, the engine management unit 2 controls the operation of the internal combustion engine 1.

The internal combustion engine 1 is then operated under closed loop lambda control in such a way that the signal from the lambda probe 7 which indicates the oxygen content of the raw exhaust gas corresponds on average to a predefined signal level. For a normal fully operable pre-converter lambda probe 7, in particular one which has not been subject to ageing factors, this signal level in the exhaust gas corresponds to $\lambda_0$, that is, to the value of lambda at which the catalytic converter 5 exhibits its optimal three-way properties.

In order to apply a fine adjustment to the level of the signal, from the pre-converter lambda probe 7, which is assigned to $\lambda_0$, and thereby to compensate for changes in the pre-converter lambda probe, a trimming controller 8 which is provided in the engine management unit 2 uses a post-converter lambda signal, the generation of which will be described in more detail below and which reports the value of lambda for the exhaust gas downstream from the catalytic converter 5, to check whether the level of the signal, from the pre-converter lambda probe 7, which has been set for lambda=1 is subject to a displacement caused, for example, by ageing. The trimming controller 8 then generates a set value which compensates for any such displacement, thus ensuring that the internal combustion engine 1 is regulated by the engine management unit 2 in such a way that the lambda value for the raw exhaust gas in the exhaust gas tract 4 upstream from the catalytic converter 5 corresponds as exactly as possible to the desired value of lambda, at which the catalytic converter 5 exhibits its optimal properties, and therefore lies within the so-called catalytic converter window.

For such trimming control, the trimming controller 8 needs a post-converter lambda signal which reports the lambda value for the exhaust gas downstream from the catalytic converter 5 with sufficient precision. In the present case, to capture this signal use is made of an $NO_x$ transducer 6 which supplies not only an $NO_x$-dependent signal but also a binary lambda signal. It would, of course, also be possible to use a separate binary lambda probe downstream from the catalytic converter 5.

Figure 2:
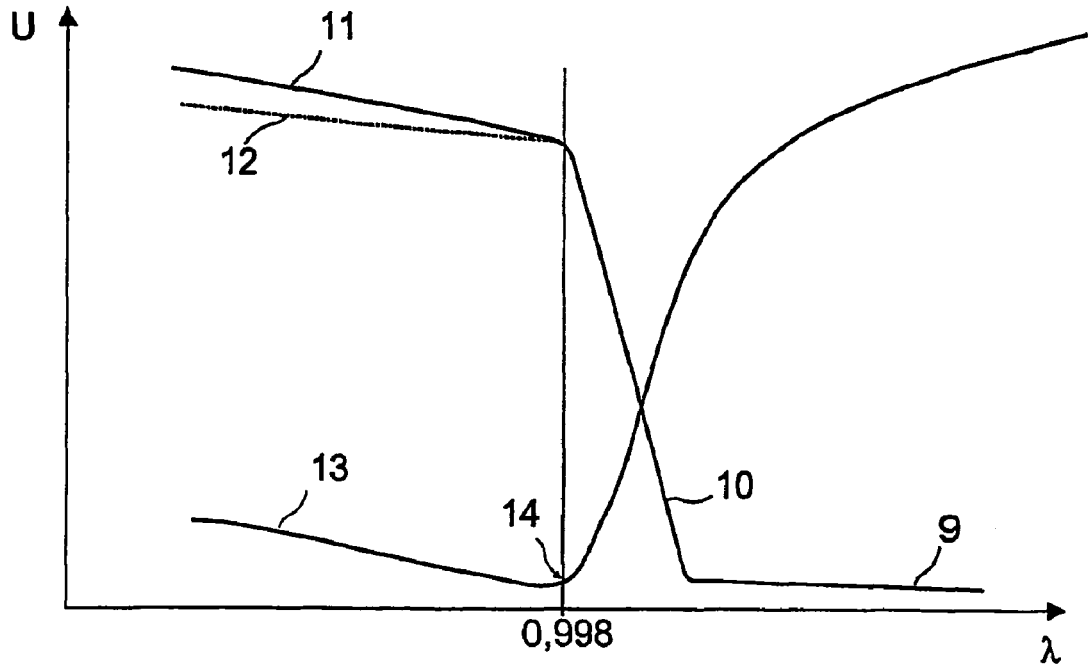
FIG. 2 illustrates the post-converter lambda signal from a binary lambda probe, and the $NO_x$ measurement signal from a $NO_x$ transducer, as functions of the lambda value.

A graph of the post-converter lambda signal as a function of the lambda value is shown by curve 9 in FIG. 2. As can be seen, the output voltage U rises as the value of lambda falls. In the lean area, for lambda values significantly above 1, the slope of curve 9 for the post-converter lambda signal is relatively flat. On the other hand, there is a section 10 of the curve, which begins at a value of lambda somewhat higher than lambda=1, over which curve 9 has a very steep slope. This is followed for values of lambda below 0.998 by a section 11 which has a very low slope. The exact position of the kink formed in this way between sections 10 and 11 depends on the type of the binary lambda probe, but it generally lies close to lambda=1. The continuous line drawn in FIG. 2 for curve 9 corresponds to the output signal from an as-new binary lambda probe with conventional three-way catalytic converters. When used downstream from catalytic converters which exhibit a high static conversion rate, and in particular which have as a consequence a raised proportion of $H_2$ in the exhaust gas stream, the slope of section 11 is on the other hand significantly flatter. This is shown in FIG. 2 as the dotted section 12. A graph with such a flat slope does not permit the lambda value to be determined from the post-converter lambda signal with the accuracy necessary for the trimming control.

For this reason, as soon as the post-converter lambda signal exceeds the threshold value, for example at the value lambda=0.998 shown in FIG. 2, the post-converter lambda signal shown by curve 9 will no longer be used by the trimming controller 8, but instead a signal from the $NO_x$ transducer 6 which indicates the $NO_x$ concentration. This signal is shown in FIG. 2 as the curve 13.

Below a certain value of lambda close to lambda=1, this signal increases as the value of lambda falls, due to the cross-sensitivity to $NH_3$ (ammonia). Over this section 13, the trimming controller 8 uses the signal from the $NO_x$ transducer for trimming control, instead of the post-converter lambda signal. In the trimming control loop, as the level of the post-converter lambda signal rises the trimming controller 8 thus switches over from the post-converter lambda signal to the measurement signal from the $NO_x$ transducer 6 at the point when the level of the post-converter lambda signal rises above a defined threshold value, in this case the signal level which corresponds to lambda=0.998.

Figure 3:
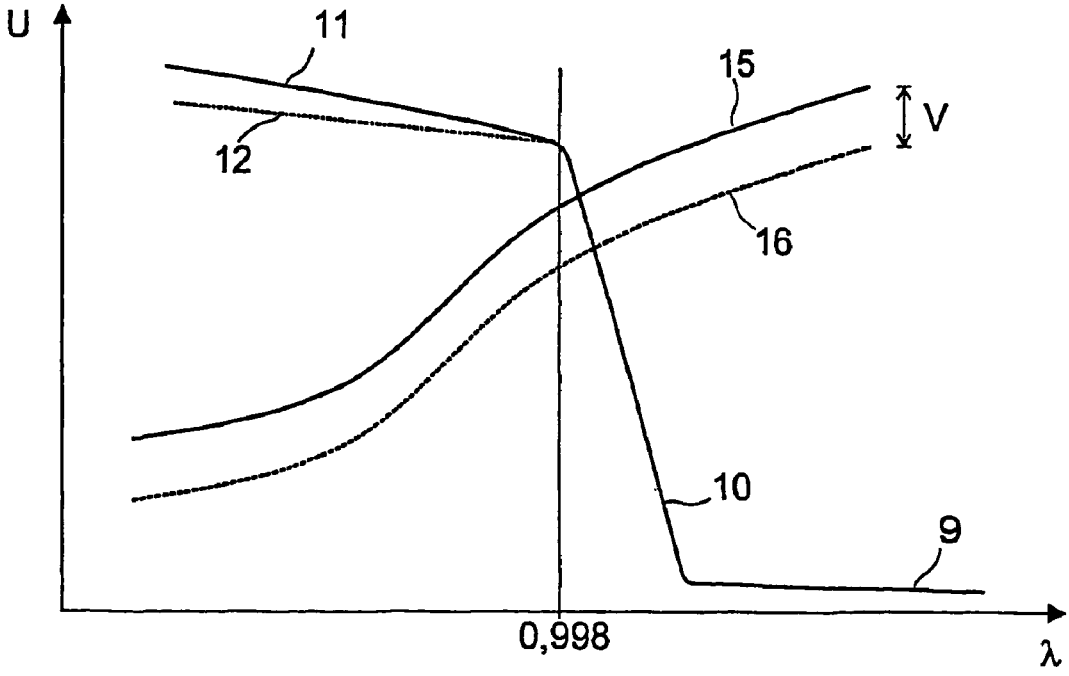
FIG. 3 illustrates the same function for the post-converter lambda signal from a binary lambda probe, and for a broadband lambda probe.

Instead of the signal from the $NO_x$ transducer 6, a broadband lambda probe can also be used. The signal from this is shown in FIG. 3, where the curve 9 for the post-converter lambda signal has again been drawn in. The broadband lambda signal 15 is a strictly monotonic increasing function of the lambda value. However, it is subject to ageing effects, which can lead to a displacement by an offset V, so that the broadband lambda signal 15 can also follow the graph shown by the reference curve 16. If such an ageing dependence arises, then the broadband lambda signal 15 is not suitable for direct use in trimming control. The trimming controller 8 then corrects the offset V in the following manner.

If the post-converter lambda signal (cf. curve 9) has a level which corresponds to the threshold value (lambda=0.998 in FIG. 3), then the level of the broadband lambda signal which is being supplied at the same time will be determined. As the lambda value at this point in time is known, this can be used to determine the current offset V of the broadband lambda signal. This value for the offset is continuously taken into account in determining the lambda value from the broadband lambda signal 15 while the trimming controller 8 is using the broadband lambda signal for trimming control, rather than the post-converter lambda signal, when the levels of the post-converter lambda signal are above the threshold value.

Alternatively, it is also possible to make continuous use of the broadband lambda signal for trimming control in that, each time that the level of the post-converter lambda signal indicates a predetermined lambda value for the exhaust gas downstream from the catalytic converter 5, the offset V is determined and is used to effect a correction to the broadband lambda signal.

The invention claimed is:

1. A method for purifying the exhaust gas from an internal combustion engine which is operated under lambda-based closed loop control and which has an exhaust gas tract in which a catalytic converter is located, comprising:

continuously sensing a pre-converter lambda value for the exhaust gas upstream of the catalytic converter, from which a pre-converter lambda signal is generated;

using this pre-converter signal as a reference variable for the lambda control loop;

continuously sensing a lambda value for the exhaust gas downstream from the converter, from which a post-converter lambda signal is generated, this being a monotonically decreasing function of the lambda value ($\lambda$) for the exhaust gas downstream from the catalytic converter; and applying a correction to the lambda control loop by using this post-converter lambda signal in a trimming control loop for correcting a signal level of the pre-lambda signal; wherein a measurement signal is generated which, at least below a certain value of lambda close to lambda=1, is a strictly monotonically increasing or monotonically decreasing function of the lambda value for the exhaust gas downstream from the catalytic converter, and for levels of the post-converter lambda signal which are above a threshold value, this supplementary measurement signal is used for trimming control, and for levels of the post-converter lambda signal which are below this threshold value, the post-converter lambda signal itself is used for trimming control.

2. The method in accordance with claim 1, wherein the post-converter lambda signal is obtained using a binary lambda probe and the measurement signal is obtained using a broadband lambda probe and on both sides of lambda=1 is a strictly monotonic increasing function of the lambda value for the exhaust gas.

3. The method in accordance with claim 2, wherein the threshold value for the post-converter lambda signal corresponds to a defined lambda value close to lambda=1, at the point in time at which the post-converter lambda signal is equal to the threshold value, the difference between the lambda value indicated by the measurement signal and the defined lambda value is determined and this difference is taken into account in the trimming controller if the measurement signal is being used by the trimming controller.

4. The method in accordance with claim 1, wherein the post-converter lambda signal is obtained using a binary lambda probe and the measurement signal is obtained from an NOx probe which exhibits cross-sensitivity to NH3 and below lambda=1 the signal is a strictly monotonically decreasing function of the lambda value for the exhaust gas.

5. The method in accordance with claim 4, wherein the threshold value for the post-converter lambda signal corresponds to that particular value of lambda close to lambda=1 below which the output signal from the NOx transducer rises as the value of lambda falls.

6. The method in accordance with one of the above claims, wherein the threshold value is 0.45 V.

7. A method for purifying the exhaust gas from an internal combustion engine which is operated under lambda-based closed loop control and which has an exhaust gas tract in which a catalytic converter is located, comprising:

continuously sensing a lambda value for the exhaust gas upstream of the catalytic converter, from which a pre-converter lambda signal is generated;

using the pre-converter signal as a reference variable for the lambda control loop;

generating a binary post-converter lambda signal by continuously sensing a post-converter lambda value for the exhaust gas downstream from the converter by a binary lambda probe, the binary post-converter lambda signal being a monotonically decreasing function of the lambda value for the exhaust gas downstream from the catalytic converter and having a two-point type graph around lambda=1; and applying a correction to the lambda control loop by using a trimming controller, wherein a broadband lambda probe is used to generate a linear post-converter lambda signal which is a strictly monotonic increasing function of the lambda value of the exhaust gas downstream from the catalytic converter, the linear post-converter lambda signal is used for trimming control, and if the binary post-converter lambda signal has a defined level the actual signal level for the linear post-converter lambda signal is simultaneously determined, the lambda value which has been assigned to the defined binary post-converter signal level is used to determine a corresponding set level for the linear post-converter signal and the trimming control takes into account any difference between the actual signal level and the set signal level as a correction factor.

8. A method for purifying the exhaust gas from an internal combustion engine which is operated under lambda-based closed loop control and which has an exhaust gas tract in which a catalytic converter is located, comprising:

continuously sensing a pre-converter lambda value for the exhaust gas upstream of the catalytic converter, from which a pre-converter lambda signal is generated;

using this pre-converter signal as a reference variable for the lambda control loop;

continuously sensing a lambda value for the exhaust gas downstream from the converter, from which a post-converter lambda signal is generated, this being a monotonically decreasing function of the lambda value ($\lambda$) for the exhaust gas downstream from the catalytic converter; and applying a correction to the lambda control loop by using this post-converter lambda signal in a trimming control loop, wherein a measurement signal is generated which, at least below a certain value of lambda close to lambda=1, is a strictly monotonically increasing or monotonically decreasing function of the lambda value for the exhaust gas downstream from the catalytic converter, for levels of the post-converter lambda signal which are above a threshold value, this supplementary measurement signal is used for trimming control, and for levels of the post-converter lambda signal which are below this threshold value, the post-converter lambda signal itself is used for trimming control, the post-converter lambda signal is obtained using a binary lambda probe, the measurement signal is obtained using a broadband lambda probe and on both sides of lambda=1 is a strictly monotonic increasing function of the lambda value for the exhaust gas, the threshold value for the post-converter lambda signal corresponds to a defined lambda value close to lambda=1, at the point in time at which the post-converter lambda signal is equal to the threshold value, the difference between the lambda value indicated by the measurement signal and the defined lambda value is determined, and this difference is taken into account in the trimming controller if the measurement signal is being used by the trimming controller.

9. The method in accordance with claim 8, wherein the threshold value is 0.45 V.

* * * * *